US007147487B2

(12) United States Patent
Barbion

(10) Patent No.: US 7,147,487 B2
(45) Date of Patent: Dec. 12, 2006

(54) POWER CONNECTOR FOR A PRINTED CIRCUIT

(75) Inventor: Alain Barbion, Sannois (FR)

(73) Assignee: Johnson Controls Automotive Electronics, Osny (FR)

( * ) Notice: Subject to any disclaimer, the term of this patent is extended or adjusted under 35 U.S.C. 154(b) by 0 days.

(21) Appl. No.: 10/472,332

(22) PCT Filed: Mar. 21, 2002

(86) PCT No.: PCT/FR02/00989

§ 371 (c)(1),
(2), (4) Date: Sep. 19, 2003

(87) PCT Pub. No.: WO02/075855

PCT Pub. Date: Sep. 26, 2002

(65) Prior Publication Data

US 2004/0105238 A1 Jun. 3, 2004

(30) Foreign Application Priority Data

Mar. 21, 2001 (FR) ..... 01 03808

(51) Int. Cl.
*H01R 23/70* (2006.01)

(52) U.S. Cl. ..... 439/79; 439/682; 439/857

(58) Field of Classification Search ..... 439/79, 439/80, 682, 857, 83; 350/96.2, 96.21
See application file for complete search history.

(56) References Cited

U.S. PATENT DOCUMENTS 3,208,026 A * 9/1965 Ruehlemann ..... 439/83
4,678,264 A * 7/1987 Bowen et al. ..... 385/89
4,742,988 A * 5/1988 Haneda et al. ..... 251/129.01
4,872,844 A * 10/1989 Grebe et al. ..... 439/69
4,908,738 A * 3/1990 Kobari et al. ..... 361/829
5,221,210 A * 6/1993 Bormuth et al. ..... 439/79
5,364,280 A * 11/1994 Colleran ..... 439/76.1
5,510,960 A 4/1996 Rosen
5,685,729 A * 11/1997 Reider et al. ..... 439/206
6,672,884 B1 * 1/2004 Toh et al. ..... 439/79
6,850,417 B1 * 2/2005 Cooper et al. ..... 361/752

FOREIGN PATENT DOCUMENTS

DE 43 07 134 A1 8/1994
DE 94 12 680 U1 7/1995

* cited by examiner

*Primary Examiner*—Hien Vu
(74) *Attorney, Agent, or Firm*—Osha Liang

(57) ABSTRACT

A power connector for a printed circuit, the connector comprising:

an insulating socket (14) provided with a bearing face (15) bearing on the printed circuit, and with a housing (16) associated with an opening (17) disposed laterally;

a pin (18, 19) passing through the bearing face perpendicularly thereto and having a connection portion (22, 27) which extends projecting into the housing and presents two faces (23, 28) parallel to a plane perpendicular to the opening;

an insulating support (31) arranged to be inserted at least in part in the housing through the opening; and at least one plug (34) secured to the insulating support and provided with two flexible tabs (35) for pressing against the faces of the connection portion of the pin.

16 Claims, 4 Drawing Sheets

POWER CONNECTOR FOR A PRINTED CIRCUIT

CROSS-REFERENCE TO RELATED PATENT APPLICATIONS

This application is a National Stage of Application PCT/FR02/00989, filed Mar. 21, 2002, incorporated herein by reference in its entirety.

BACKGROUND

The present invention relates to a power connector usable, in particular, with a printed circuit card, e.g. for use in controlling electrical actuators, and, in particular, electromagnetic actuators.

In the automotive field, an ever-increasing number of high-power electrical actuators are being used. At present, power is supplied to such actuators by power modules associated with a card having power conductor tracks leading to the actuators. A problem associated with that type of power supply is connecting said power tracks to the power supply conductors of the actuators, where such connection must be releasable so as to enable the power supply card to be replaced in the event of failure. In addition, very tight constraints on size lead to a requirement for the power supply conductors to depart from the printed circuit parallel therewith, and close thereto.

Numerous connector structures are presently in existence. Nevertheless, none of them constitutes a good match for satisfying the above-mentioned constraints.

SUMMARY

One embodiment provides a power connector for a printed circuit. The connector comprises an insulating socket provided with a bearing face bearing on the printed circuit, and with a housing associated with an opening disposed laterally, at least one pin passing through the bearing face perpendicularly thereto and having a connection portion which extends projecting into the housing and presents two faces parallel to a plane perpendicular to the opening, an insulating support arranged to be inserted at least in part in the housing through the opening, and at least one plug secured to the insulating support and provided with two flexible tabs for pressing against the faces of the connection portion of the pin.

The structure of the connector is thus relatively compact while allowing relatively high-power electric current to be conveyed, and with the support being easy to insert into the socket parallel to the bearing surface. This connection therefore does not require conductors to be curved in order to cause them to depart parallel to the printed circuit. This contributes to minimizing the volume occupied for connection purposes.

Preferably, the pin comprises a tab which is cut out from a conductive plate forming the printed circuit, and it is folded so as to extend perpendicularly to the plate.

The pin is then made in a manner that is particularly simple, integrally with the conductive plate forming the printed circuit.

BRIEF DESCRIPTION OF THE DRAWINGS

Other characteristics and advantages of the invention appear on reading the following description of a particular, non-limiting embodiment of the invention.

Reference is made to the accompanying drawings, in which.

MORE DETAILED DESCRIPTION

Figure 7:
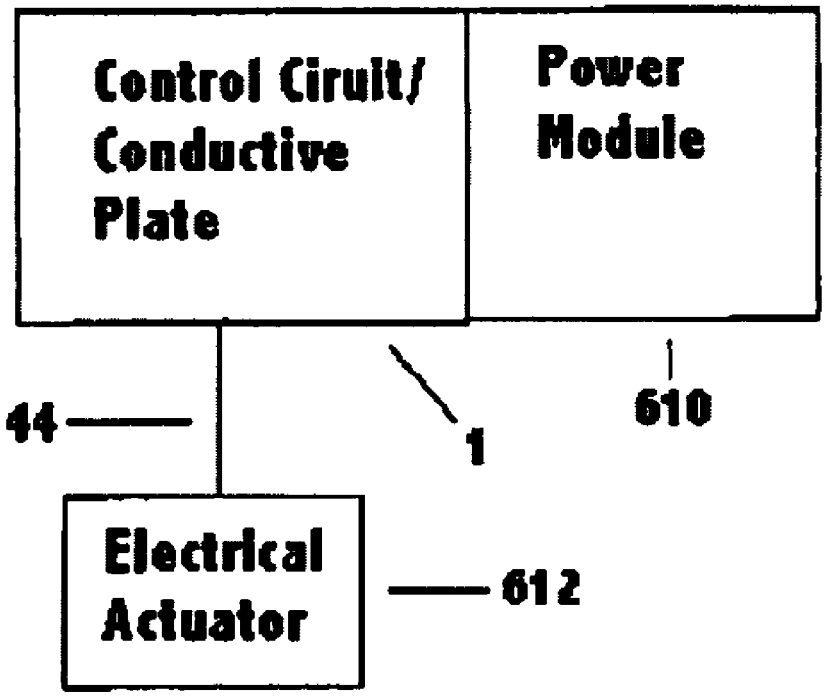
FIG. 7 is a block diagram of a power system according to one embodiment.

The invention is described herein with reference to a printed circuit card for receiving a power module 610 (FIG. 7) of conventional type and associated with a power connector for supplying power to an electrical actuator 612 (FIG. 7) which is connected to the power module 612 via the connector.

With Reference to FIGS. 1 to 5*a*, the card 1 comprises an insulating plate 2 having two opposite faces 3 and 4 carrying a control circuit 5 and two power circuits 6 and 7.

The control circuit 5 is implemented in the form of conductor tracks printed on the face 3 of the insulating plate 2. The control circuit 5 is connected to the power module to transmit low power control signals coming from and going to the power module, and for connecting the power circuits 6 and 7 to the power module via short segments capable of conveying higher-power signals without being subjected to heating which might damage them.

The power circuits 6 and 7 are of the lead frame type comprising, respectively, a conductive plate 8 fixed to the face 4 of the insulating plate 2, and a conductive plate 9 fixed to the conductive plate 8. The conductive plates 8 and 9 are made of copper having thicknesses sufficient to conduct power, and which include conductor tracks. The conductive plates 8 and 9 also include holes 40, 41 for passing connection pins of the power module and any other components that might be mounted on the card (e.g. coils 12, of FIG. 2). The holes 40, 41 have an opening size greater than the size of the connection pins so that the connection pins do not come into contact with the plates 8 and 9.

Figure 2:
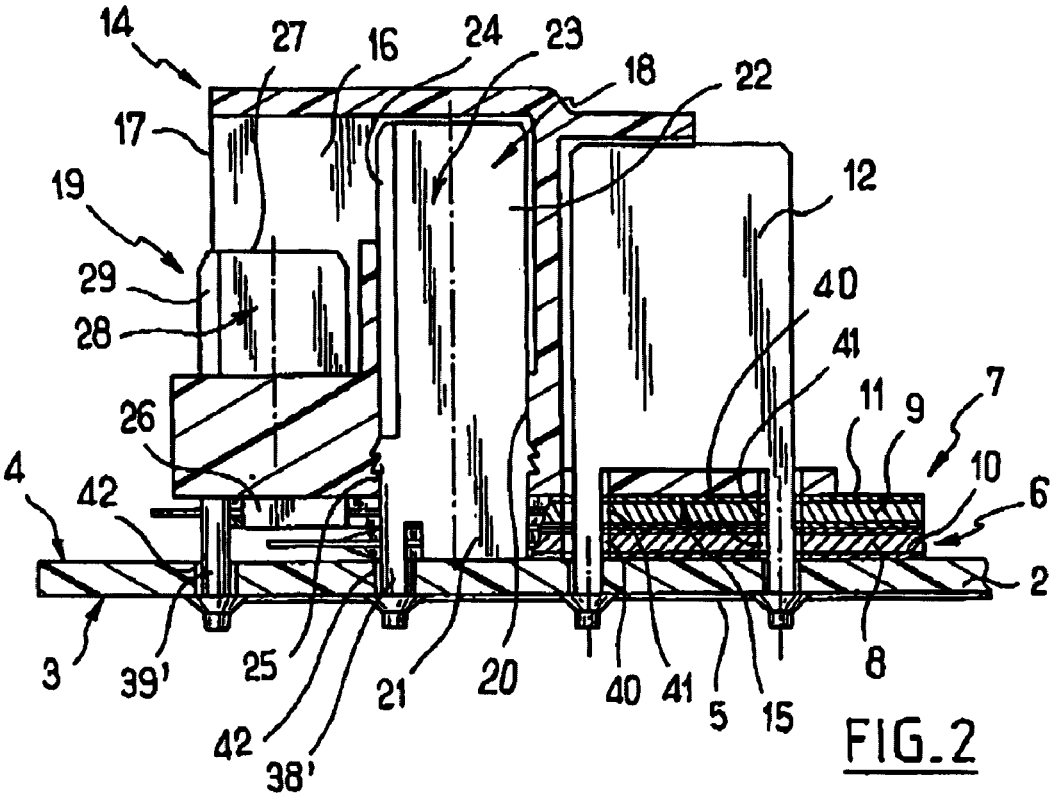
FIG. 2 is a fragmentary section view through the card and the connector.
Figure 3:
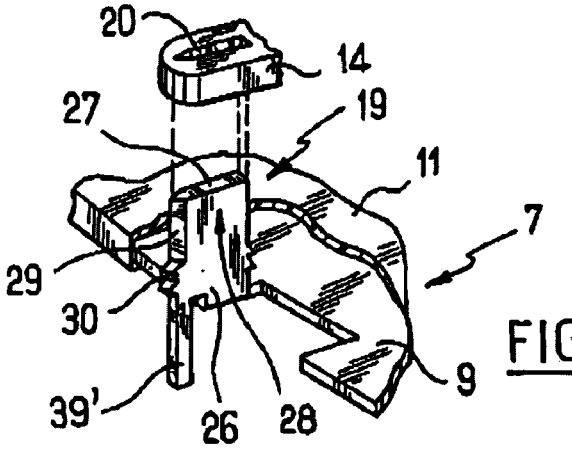
FIG. 3 is a fragmentary exploded view of the connector.
Figure 4:
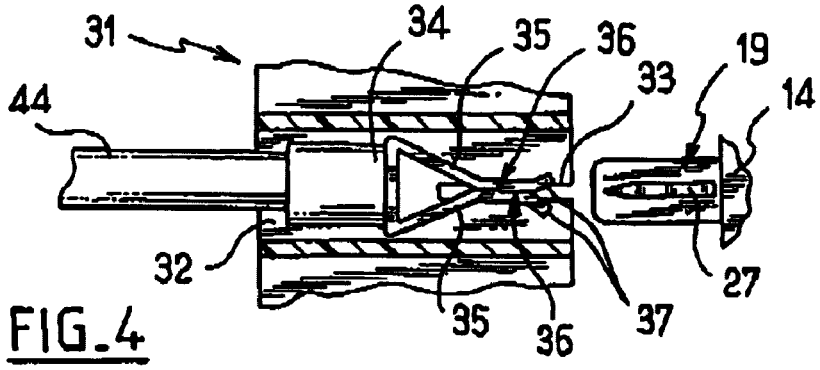
FIG. 4 is a fragmentary cutaway plan view of the connector.

Each of the conductive plates 8, 9 is cased in an insulating layer 10, 11 (FIG. 2). The insulating layers 10 and 11 are formed in this case by flexible sheets of insulating material having an adhesive face enabling the sheets to be held on the conducive plates 8 and 9. By means of the insulating layers 10 and 11 interposed between the conductive plates 8 and 9, the power circuits 6 and 7 can be placed one on the other, thereby limiting the volume they occupy. The insulating layers 10 and 11 have openings in register with the holes 40 and 41.

Tracks of the conductive plate 8 have end portions 38 extending substantially perpendicularly to the conductive plate 8 projecting from the insulating layer 10. In the same manner, tracks of the conductive plate 9 comprising end portions 39 extend substantially perpendicularly to the conductive plate 9 projecting from the insulating layer 11. It will be observed that the power circuits can thus form subassemblies ready for mounting on the printed circuits.

The end portions 38 are received in holes 42 formed in the insulating plate 2. Each of the end portions 38 has a free end fixed to and projecting from the control circuit 5. In analogous manner, the end portions 39 are received in holes 43 formed in the power circuit 6 and in the corresponding holes 42 in the insulating plate 2, and each has a free end fixed to and projecting from the control circuit 5. The free ends of the end portions 38 and 39 are fixed to the control circuit 5 by soldering.

As mentioned above, the segments of the control circuit 5 to which the end portions 38 and 39 are fixed are very short in length so as to make it possible for them to conduct relatively high currents (about 20 amps) without being subjected to excessive heating which might damage them.

The end portions 38 and 39 serve firstly to connect the conductive plates 8 and 9 to the control circuit 5 in order to convey power signals between the power module and the actuator, and secondly to fasten the power circuits 6 and 7 mechanically to the insulating plate 2.

In order to improve this fastening, additional end portions 38', 39' are provided which are soldered to segments of the control circuit that are not connected to the power module and that serve only for fastening the power circuit in question.

Figure 5A:
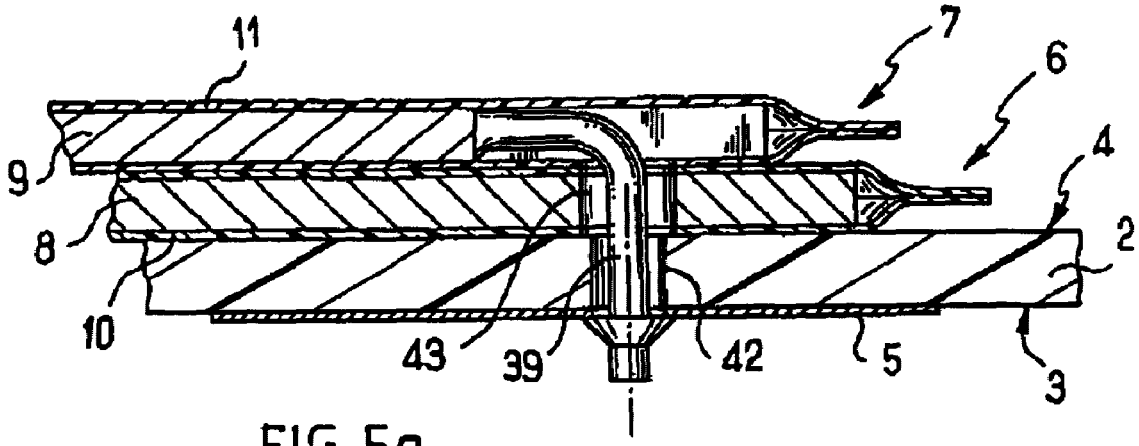
FIG. 5*a* and 5*b* are section views of the card showing the circuits connected to one another.
Figure 5B:
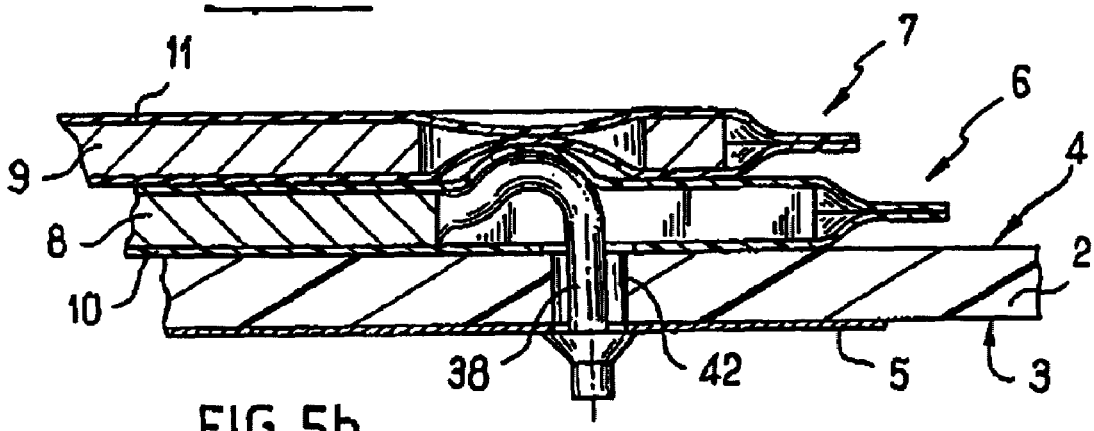

It will be observed, in particular in FIG. 5*b*, that the flexibility of the insulating layers 10 and 11 enables them to match the shape of the bent region of an end portion 38, said bent region projecting from the plate 8 into an opening of the conductive plate 9. This makes it possible to further limit the overall size of the superposed power circuits.

The power circuits 6 and 7 of the card 1 are connected to the electrical actuator with which they are to co-operate via a connector 13.

The connector 13 comprises a socket 14 which is made of insulating material and which comprises both a bearing face 15 bearing on the power circuit 7, and a housing 16. The housing is associated with opening 17 that opens laterally.

Pins 18 and 19 pass through the bearing face 15 perpendicularly thereto and extend into holes 20 in the socket 14.

The pins 18 extend in openings of the power circuit 7 and each has one end 21 connected to the conductive plate 8 and an opposite end forming a connection portion 22 which projects into the housing 16. The end 21 is extended away from the connection portion 22 by one of the additional end portions 38' that are soldered to segments of the control circuit 5 that are not connected to the power module. The connection portion 22 has two faces 23 parallel to a plane perpendicular to the opening 17 (the plane of the sheet in FIG. 2) and a chamfered edge 24 facing towards the opening 17. The pins 18 possess anchoring barbs 25 engaged in the insulating socket 14.

The pins 19 are disposed beyond the pins 18, each having one end 26 connected to the conductive plate 9 and an opposite end forming a connection portion 27 which projects into the housing 16. The end 26 is extended away from the connection portion 27 by one of the additional end portions 39' received in the holes 42 and soldered to segments of the control circuit 5 that are not connected to the power module. The connection portion 27 has two faces 28 parallel to a plane perpendicular to the opening 17 (the plane of the sheet in FIG. 2) and a chamfered edge 29 facing towards the opening 17. The pins 19 possess anchoring barbs 30 engaged in the insulating socket 14.

In this case, the pins 18 and 19 are formed by tabs cut out in the corresponding conductive plate 8 or 9 and folded to extend perpendicularly thereto through the corresponding insulating layer 10 or 11.

The pins 18 and 19 are disposed in two rows that are offset from each other. The pins 19 are adjacent to the opening 17 and are of a height in the housing 16 which is less than the height of the pins 18. This arrangement makes it possible to limit the volume occupied by the connector 13.

The socket 14 also serves as a support on which the coils 12 are mounted with their connection pins extending in holes formed in register therewith in the socket 14, in the power circuits 6 and 7, and in the insulating plate 2; the connection pins of the coils 12 having free ends projecting beyond the control circuit 5 and soldered thereto.

The connector also comprises a support 31 which is made of an insulating material and is arranged to be inserted at least in part in the housing 16 via the opening 17.

Figure 1:
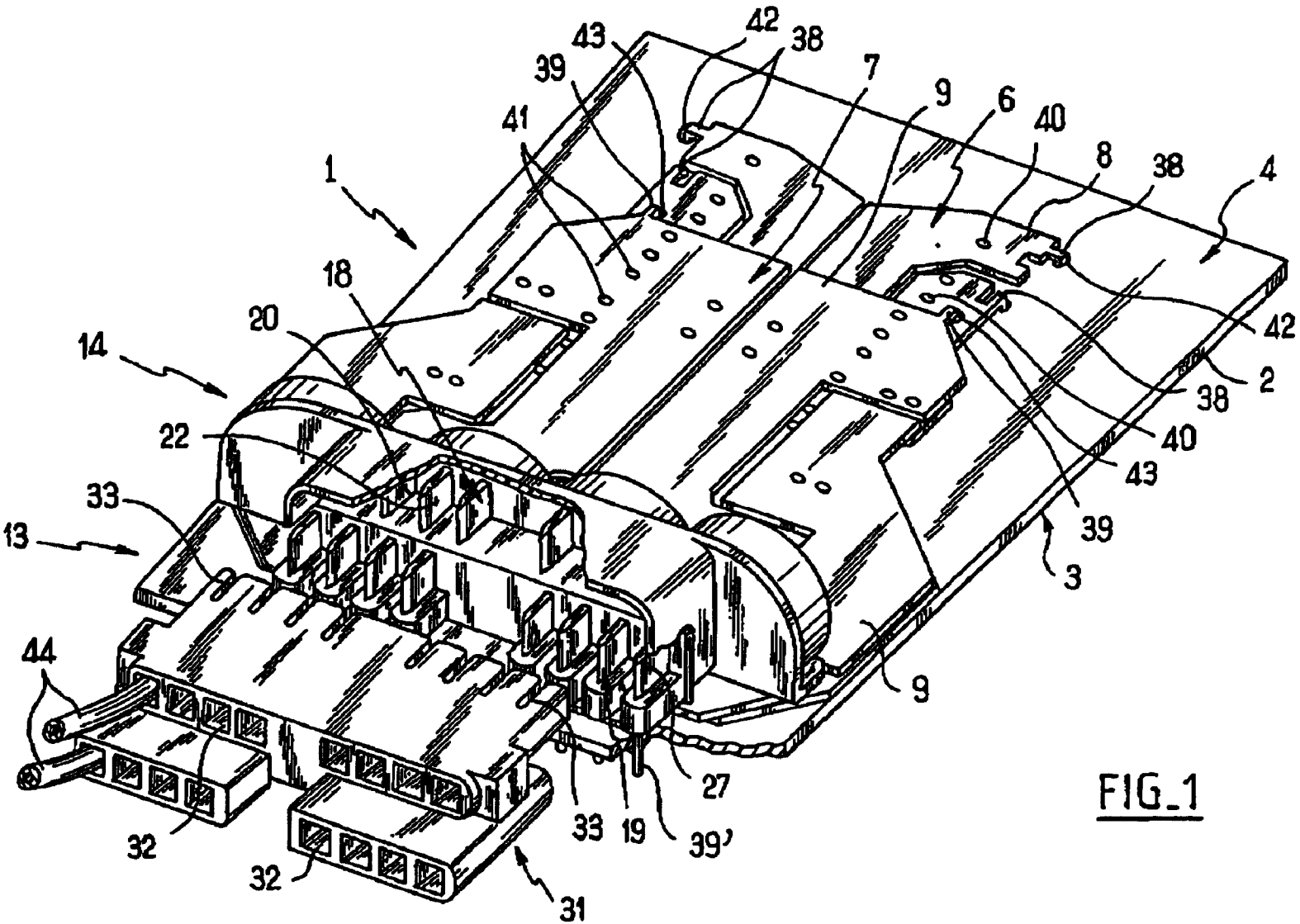
FIG. 1 is a partially cutaway fragmentary perspective view of a printed circuit card associated with a connector constituting a particular embodiment of the invention.

The support 31 has housings 32 each presenting a respective longitudinal slot 33 for receiving a pin 18 or 19, and each receiving a plug 34 (FIG. 4) fixed in a housing 32. Each plug 34 possesses one end connected to a conductor 44 (FIGS. 1 and 4) for connection to the electrical actuator (only two conductors are shown in FIG. 1) and an opposite end carrying two flexible tabs 35 facing the slot 33, which tabs 35 are elastically deformable between a first state in which the two flexible tabs 35 present respective surfaces 36 pressed against each other, and a second state in which the surfaces 36 are spaced apart from each other (see FIG. 4 in particular). The flexible tabs 35 have diverging free ends 37.

The plugs 34 that connect to the pins 18 project beyond and are located above the plugs 34 that connect to the pins 19 (see FIG. 1).

To make the card, the socket 14 is engaged by force onto the pins 18 and 19. The barbs 25 and 30 then become anchored in the walls of the holes 20 and hold the socket 14 pressed against the power circuit 7 via the bearing face 15. The control circuit 5 is made on the face 3 of the support plate 2 while the power circuits 6 and 7 and then the power module and the coils 12 are mounted on the insulating plate 2 via its face 4. The free ends of the end portions 38, 39, 38', 39' and the connection pins of the power module and of the coils 12 are then soldered to the control circuit 5. Soldering is preferably performed in this case by a flow soldering technique. It should be observed that all of the components of the card, including its power circuits 6 and 7 are fastened to the insulating plate 2 in this way and are connected to the control circuit 5 in a manner that is particularly easy and may be done in a single operation.

Connection is established by engaging the support 31 in the housing 16 through the opening 17 in a direction parallel to the bearing face 5 and to the insulating plate 2. Such insertion does not require the conductors 44 to be curved in order for the conductors 44 to extend from the card 1 in a direction that is parallel to the card 1, thus making it possible to provide a connection of minimum size.

When the connection portions 22 and 27 of the pins 18 and 19 are engaged in the slots 33, the free ends 37 of the plugs 34 come into contact with the chamfered edges 24 and 29 of the pins 18 and 19. The free ends 37 are spaced apart by said chamfered edges 24 so as to bring the surfaces 36 of the plugs 34 into contact with the faces 23 and 28 of the pins 18 and 19. The elasticity of the material constituting each plug 34 serves to keep the surfaces 36 thereof in contact with the faces 23 or 28 of the corresponding pin 18 or 19. The depth of the slot 33 determines the depth to which the pin 18, 19 can be inserted into the plug 34 in such a manner that, at maximum insertion, the surfaces 36 and the faces 23 and 28 are in register.

It will be observed that the structure of the connector 13 is thus relatively compact, which provides good transmission of electric current of relatively high power and also makes it easy to insert the support 31 into the socket 14 parallel to the bearing surface 15.

Figure 6:
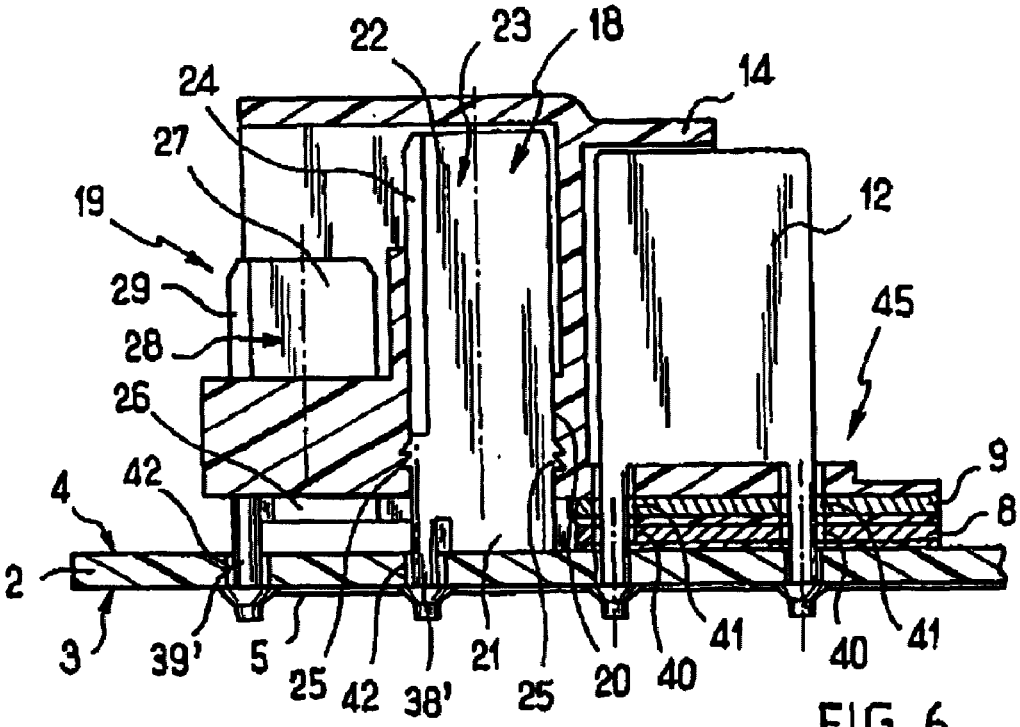
FIG. 6 is a view analogous to FIG. 2 showing a variant embodiment of the invention.

In a variant, as shown in FIG. 6, the insulating layers 10 and 11 are made of a rigid insulating material molded around the plates 8 and 9, and the socket 14 is made out of the same material so as to constitute, together with the insulating layers 10 and 11, a single piece 45. The conductive plates 8 and 9 are then used as inserts in the mold into which the material for constituting the part 45 is injected.

Naturally, the invention is not limited to the embodiment described and variants can be applied thereto without going beyond the scope of the invention as defined by the claims.

In particular, although the pins 18 and 19 are described as being cut out in the conductive plates 8 and 9, and as being folded so as to extend perpendicular to the plates, thereby simplifying the structure of the power circuits 6 and 7, the pins 18 and 19 could be separate pieces fitted to the power circuits 6 and 7.

In addition, the support plate 2 may be made of a material that conducts heat, such as aluminum (with an insulating layer then being interposed between the plate and the circuit), thereby contributing to cooling the circuits.

The insulating layers 10, 11 need cover only one face of each conductive plate 8, 9.

Furthermore, the card could have only one power circuit or could have more than two power circuits.

The pins 18 and 19 could be arranged differently, for example their positions could be interchanged.

What is claimed is:

1. A power connector (13) for a power circuit comprising conductive plates fixed on an insulating plate, the connector comprising:

an insulating socket (14) provided with a bearing face (15) bearing on the circuit, and provided with a housing (16) having a laterally disposed opening (17);

at least one pin (18, 19) passing through the bearing face perpendicular to the bearing face, the pin having a connection portion (22, 27) which extends into the housing, the connection portion comprising two faces (23, 28) which are parallel with a plane that is perpendicular to a plane of the laterally disposed opening, the pin being formed, at least in part, from a tab which is cut out from one of the conductive plates and is folded so as to extend perpendicularly to the conductive plates;

an insulating support (31) arranged to be inserted, at least in part, in the housing through the opening;

at least one plug (34) secured to the insulating support and provided with two flexible tabs (35) for pressing against the faces of the connection portion of the pin a plurality of pins (18, 19) positioned in the insulating socket (14), the plurality of pins arranged in at least a first row of pins and a second row of pins, the first row of pins and second row of pins being offset relative to each other, and a plurality of plugs (34) disposed in the insulating support (31) and arranged to correspond to the first and second offset rows of pins;

wherein the conductive plates comprise holes at rear sections.

2. A power connector according to claim 1, wherein the pin (18, 19) includes at least one anchoring barb (25, 30) anchored in the insulating socket (14).

3. A power connector according to claim 1, wherein the first row of pins is adjacent to the opening (17), and of the first row of pins have a height that is shorter than the height of the second row of pins.

4. A power connector for a power circuit comprising:

conductive plates comprising holes at rear sections, the conductive plate being coupled to a power module by a control circuit;

a pin formed, at least in part, from a tab which is cut out from one of the conductive plates;

a socket that contains the pin attached to the conductive plates, the socket having an opening configured to receive a support having conductors;

a plurality of pins positioned in the insulating socket, the plurality of pins arranged in at least a first row of pins and a second row of pins, the first row of pins and second row of pins being offset relative to each other, and a plurality of plugs disposed in the insulating support and arranged to correspond to the first and second offset rows of pins wherein the control circuit is connected to coil.

5. The power connector of claim 4, wherein the conductive plate is fixedly coupled to an insulating plate.

6. The power connector of claim 4, wherein segments of the control circuit that couple the conductive plate and power module are sufficiently short in length so as to make it possible for the segments to conduct currents of about 20 amps without being subjected to heating which would cause damage to the segments.

7. The power connector of claim 4, wherein the socket comprises an insulating socket and the pin extends through the insulating socket.

8. The power connector of claim 7, wherein the conductive plate does not extend through the insulating socket.

9. The power connector of claim 7, wherein the pin extends through a face of the socket and extends perpendicular to a plane of the face.

10. The power connector of claim 7, wherein the socket comprises an opening that is disposed laterally with respect to the conductive plate.

11. The power connector of claim 4, further comprising a support that is configured to be inserted in the socket such that conductors in the support can be electrically coupled to the pin.

12. The power connector of claim 11, wherein the conductors of the support are configured to provide power to an electrical actuator.

13. The power connector of claim 12, wherein the electrical actuator comprises an electromagnetic actuator.

14. The power connector of claim 12, wherein the opening is disposed laterally with respect to the conductive plate.

15. The power connector of claim 12, wherein the conductors of the support do not need to be curved in order for the conductors to extend from the conductive plate in a direction that is parallel to the conductive plate.

16. The power connector of claim 4, wherein the pin is configured to provide power to an electrical actuator.

* * * * *